US006135240A

United States Patent [19]

Apostolopoulos

[11] Patent Number: 6,135,240

[45] Date of Patent: Oct. 24, 2000

[54] BRIDGE PLATFORM

[75] Inventor: Lambros Apostolopoulos, Amherst, N.Y.

[73] Assignee: Paul Kristen, Inc., Tonawanda, N.Y.

[21] Appl. No.: 09/352,227

[22] Filed: Jul. 13, 1999

Related U.S. Application Data

[63] Continuation of application No. 08/912,405, Aug. 18, 1997, Pat. No. 5,921,346, which is a continuation of application No. 08/506,685, Jul. 25, 1995, Pat. No. 5,730,248.

[51] Int. Cl.[7] ..... E04G 3/00

[52] U.S. Cl. ..... 182/150; 182/138

[58] Field of Search ..... 182/150, 138; 14/18

[56] References Cited

U.S. PATENT DOCUMENTS

| | | | |
|---|---|---|---|
| 629,935 | 8/1899 | Sturgis . | |
| 2,675,201 | 4/1954 | Friel . | |
| 3,550,723 | 12/1970 | Gentry et al. . | |
| 3,603,423 | 9/1971 | Hanses . | |
| 3,603,428 | 9/1971 | Hanses | 182/222 |
| 3,667,185 | 6/1972 | Maurer . | |
| 3,857,210 | 12/1974 | Austin . | |
| 3,858,364 | 1/1975 | Proulx . | |
| 4,660,680 | 4/1987 | Potin | 182/150 |
| 4,854,419 | 8/1989 | Lyras et al. . | |
| 5,299,655 | 4/1994 | Margaritis | 182/150 |
| 5,417,026 | 5/1995 | Brumfield . | |
| 5,730,248 | 3/1998 | Apostolopoulos . | |
| 5,921,346 | 7/1999 | Apostolopoulos . | |

FOREIGN PATENT DOCUMENTS

| | | |
|---|---|---|
| 2596441 | 2/1987 | France . |

*Primary Examiner*—Alvin Chin-Shue
*Attorney, Agent, or Firm*—James C. Simmons

[57] ABSTRACT

A bridge platform and method of erecting the same wherein a plurality of cables extend longitudinally of the bridge in spaced relation below the deck or roadway and steel support structure of the bridge, which cables are supported at opposite ends by the spaced-apart vertical piers of the bridge, and wherein a plurality of platform flooring panels or sections are supported on the cables, extend laterally of the bridge, are arranged side-by-side along the length of the bridge between the piers and are removably secured to the cables. The cables are attached to the bridge piers by compression clamp structures. The platform flooring sections comprise elongated rectangular corrugated decking panels and are arranged in end-to-end overlapping relation transversely of the bridge, side-to-side overlapping relation longitudinally along the bridge and with the corrugations extending transversely of the cables. The corrugations maximize the strength-to-weight ratio of the platform flooring and provide recesses or receptacles to contain debris and facilitate its collection and removal. Each of the platform flooring sections is releasably connected at spaced locations to the supporting cables on which it rests. This is provided by connector assemblies each comprising a first part which engages the upper surface of the flooring section and the cable and a second part which engages the upper surface of the flooring section, the two parts being removably connected together through a small opening in the flooring. As a result, individual flooring sections can be removed to provide access through the flooring in emergency or critical situations while at the same time allowing the remainder of the flooring to retain collected debris.

13 Claims, 8 Drawing Sheets

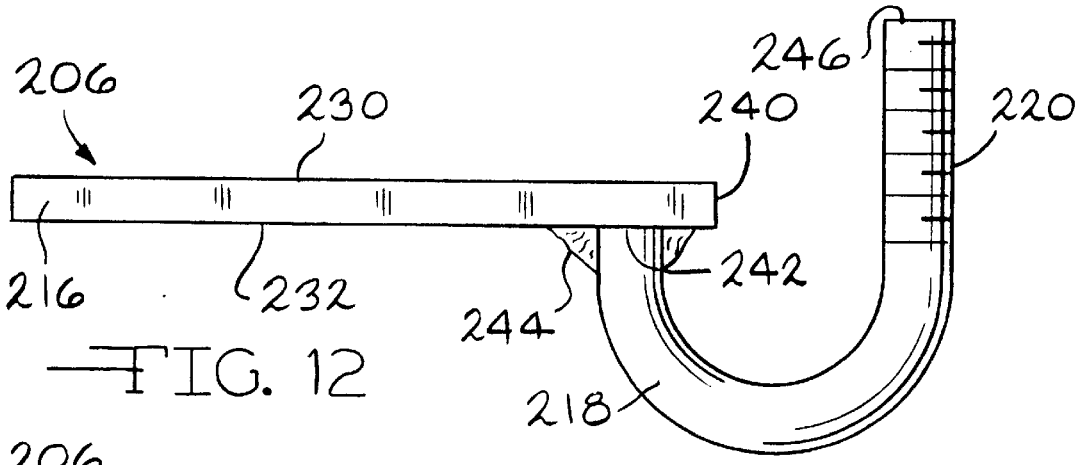
FIG. 12
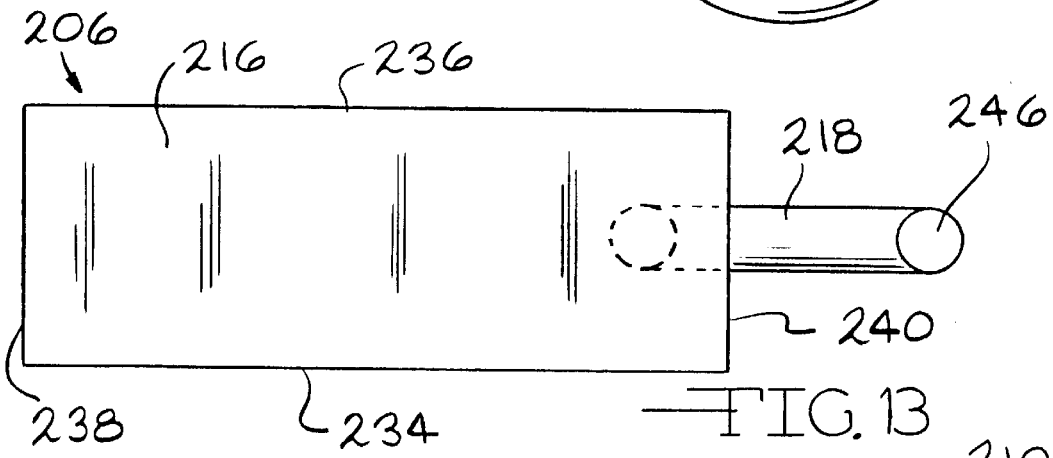
FIG. 13
FIG. 14
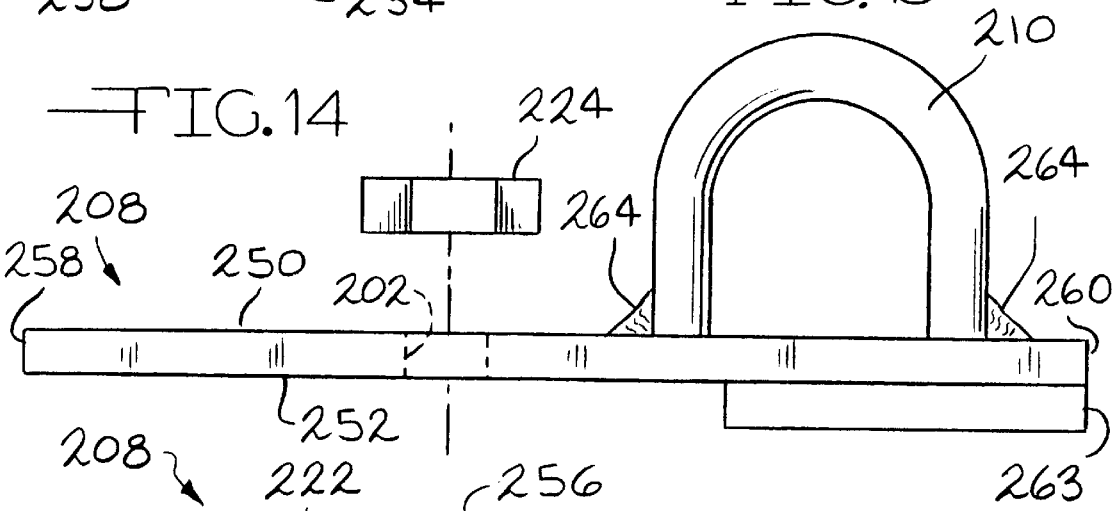
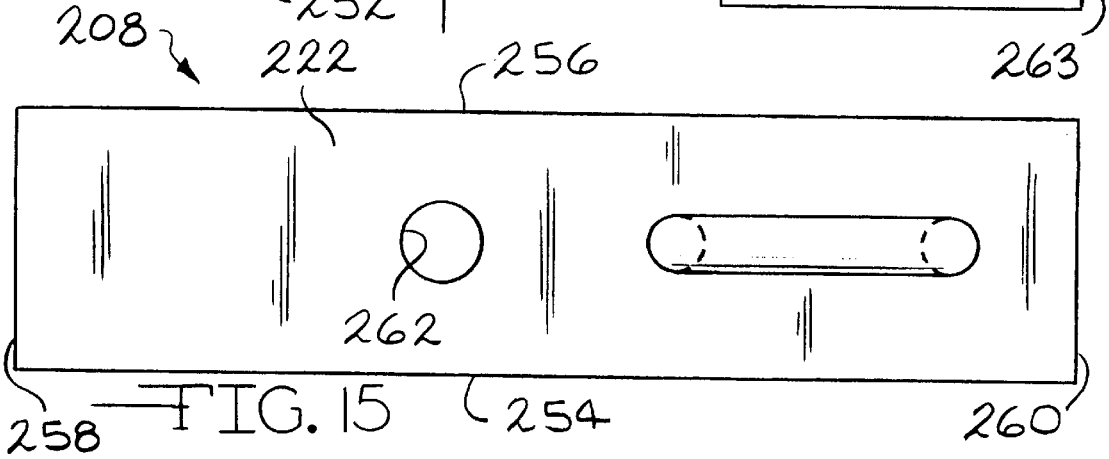
FIG. 15

BRIDGE PLATFORM

This application is a continuation of application Ser. No. 08/912,405, filed Aug. 18, 1997 (now U.S. Pat. No. 5,921, 346), which is a continuation of application Ser. No. 08/506, 685, filed Jul. 25, 1995 (now U.S. Pat. No. 5,730,248.

BACKGROUND OF THE INVENTION

This invention relates to the art of working platforms for supporting persons performing work on structures, and more particularly to a new and improved platform installed below the deck or roadway of a bridge.

It is necessary to periodically clean and repaint the surfaces of steel bridges to prevent corrosion and deterioration of the steel supporting structure. This, in turn, creates the need to provide a safe and effective support for workmen performing the cleaning and painting of the surfaces beneath the deck or roadway of the bridge. In addition, environmental concerns and regulations give rise to the need for containing the debris from the cleaning operation as well as paint residue and spillage.

A number of bridge platforms have been proposed but many are complex structures and time consuming to erect and dismantle. Other prior art platforms are not sufficiently rigid or are limited in height, i.e., the distance between platform flooring and bridge steel structure, due to the manner in which they are attached to the bridge. Some prior platforms extend for only a short distance longitudinally of the bridge and are limited in that respect.

It would, therefore, be highly desirable to provide a new and improved bridge platform and method of erecting the same which is safe, provides a sufficiently rigid support for workman standing and walking thereon, which is simple in structure, light in weight, and therefore quick, easy and economical to erect and dismantle, which extends for a significant portion of the length of the bridge and which is effective in containing debris from the cleaning and painting operations performed on the bridge.

SUMMARY OF THE INVENTION

The present invention provides a bridge platform and method of erecting the same wherein a plurality of cables extend along a section of the bridge in spaced relation below the deck or roadway and steel support structure of the bridge, which cables are supported at opposite ends by a structure of the bridge such as the spaced-apart vertical piers of the bridge, and wherein a plurality of platform flooring panels or sections are supported on the cables, extend laterally of the cables, are arranged side-by-side along the section of the bridge such as between the piers and are removably secured to the cables. The cables preferably are attached to the bridge piers by compression clamp structures. The platform flooring sections comprise elongated rectangular corrugated decking panels and are arranged in end-to-end overlapping relation transversely of the cables, side-to-side overlapping relation along the bridge and with the corrugations extending transversely of the cables. The corrugations maximize the strength-to-weight ratio of the platform flooring and provide recesses or receptacles to contain debris and facilitate its collection and removal. Each of the platform flooring sections is releasably connected at spaced locations to the supporting cables on which it rests. This is provided by connector assemblies each comprising a first part which engages the upper surface of the flooring section and the cable and a second part which engages the upper surface of the flooring section, the two parts being removably connected together through a small opening in the flooring. As a result, individual flooring sections can be removed to provide access through the flooring in emergency or critical situations while at the same time allowing the remainder of the flooring to retain collected debris.

The foregoing and additional advantages and characterizing features of the present invention will become clearly apparent upon a reading of the ensuing detailed description wherein:

BRIEF DESCRIPTION OF THE DRAWING FIGURES

FIG. 12 is a side elevational view of one part of the connector assembly included in the platform of the present invention;

FIG. 13 is a plan view of the connector assembly of FIG. 12;

FIG. 14 is a side elevational view of the second part of the connector assembly of the present invention;

FIG. 15 is a plan view of the connector assembly of FIG. 14; and

DETAILED DESCRIPTION OF THE ILLUSTRATED EMBODIMENT

Figure 1:
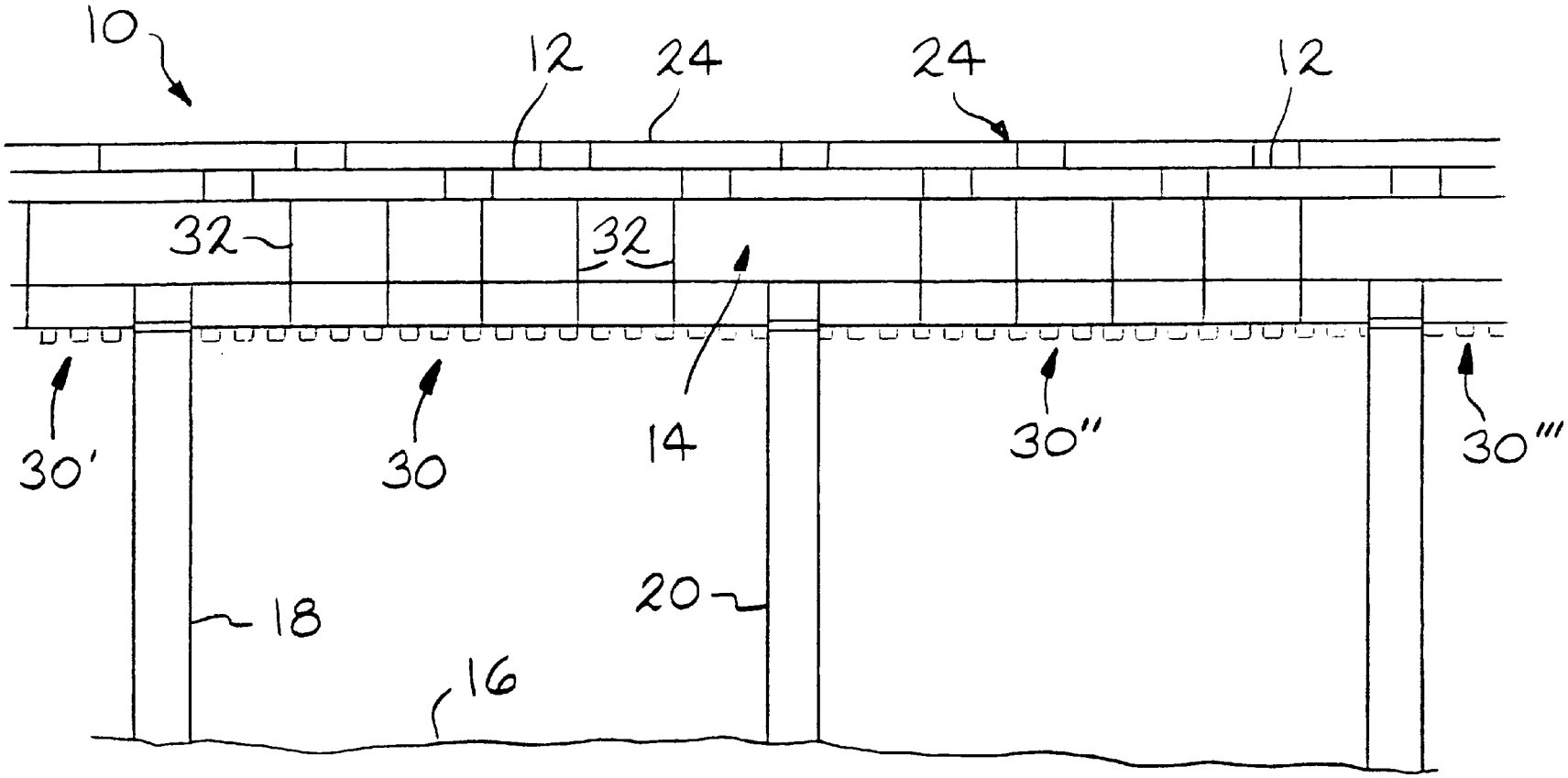
FIG. 1 is a fragmentary side elevational view, partly diagrammatic, of a bridge having a platform according to the present invention installed thereon.

Referring first to FIG. 1, there is shown a portion of a bridge 10 including a deck or roadway 12 supported by structural steel 14 which, in turn, is supported above the ground 16 by concrete piers or pedestals at regular intervals along the length of the bridge. Two piers 18 and 20 are shown on the bridge section of FIG. 1, although many such piers are included along the total length of an actual bridge. A railing 24 is shown extending along the length of bridge deck 12. The platform 30 of the present invention in the situation illustrated herein is located below the bridge deck 12 and between the piers 18, 20 and is supported from the piers 18, 20 and bridge structural steel 14. The platform 30, which will be described presently, includes a plurality of cables (not shown in FIG. 1) extending lengthwise of bridge 10 and supported at opposite ends by piers 18, 20 and a plurality of flooring sections supported by the cables, each extending transversely of the cables and also transversely of bridge 10, and the sections are in side-by-side relation along the length of bridge 10. Each flooring section is removably connected at spaced locations thereon to the cables. The platform also is supported at spaced locations therealong by the bridge structural steel 14 by means of support cables, some of which are designated 32 in FIG. 1. While the present description is directed to the single platform 30, a plurality of platforms, three of which are designated 30', 30" and 30'" in FIG. 1 can be provided along the length of bridge 10.

Figure 2:
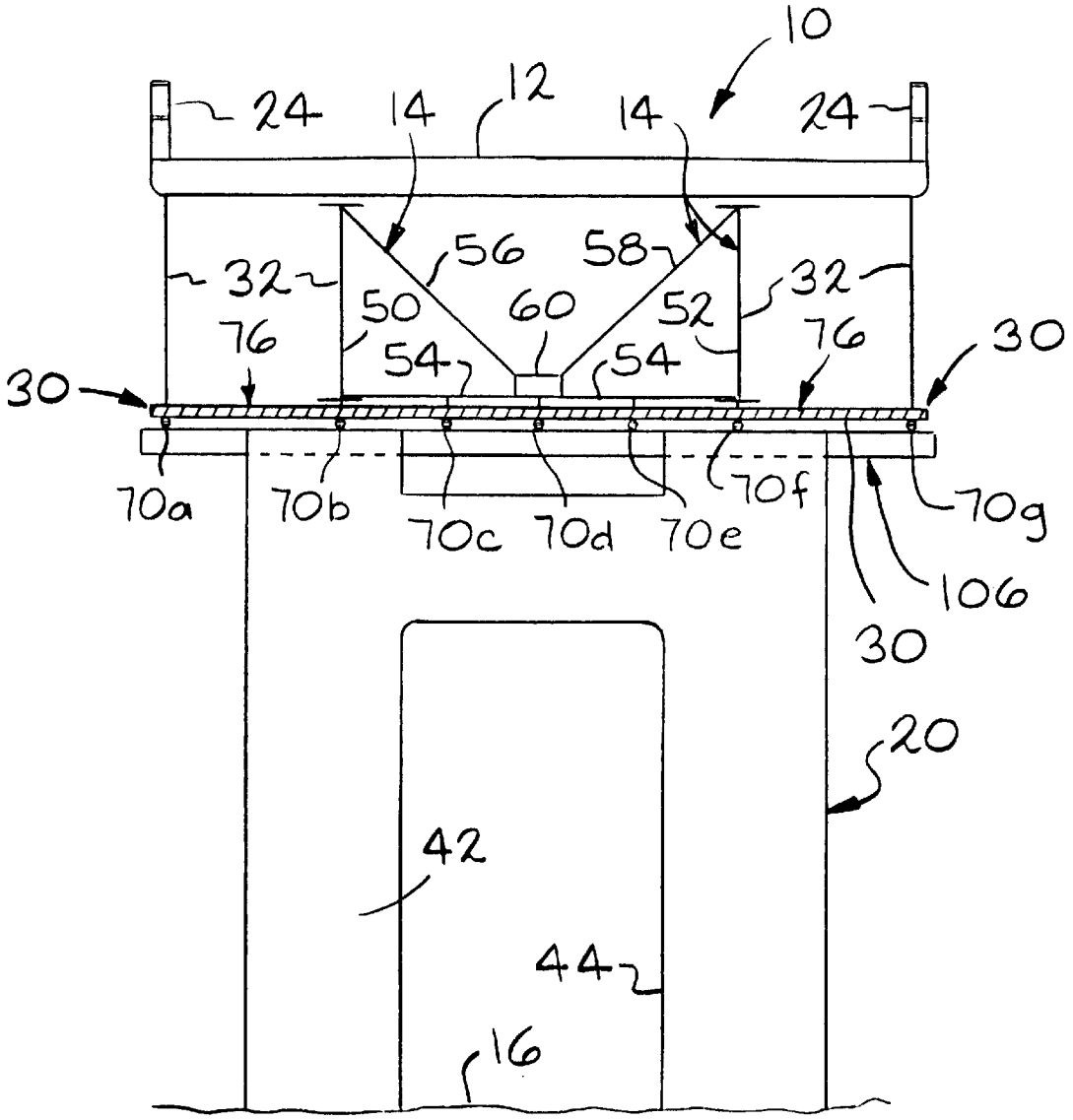
FIG. 2 is a fragmentary cross-sectional view, partly diagrammatic, of the bridge platform of FIG. 1.

Referring now to FIG. 2, there is shown one of the bridge piers, for example pier 20, which has a pair of vertical pedestals or columns 42 and 44 joined near the upper ends by a central body 46. The bridge structural steel 14 includes sidewalls 50 and 52 which rest on the tops of pedestals 42 and 44, respectively, and which are connected at spaced locations along the length of bridge 10 by a series of assemblies each including a horizontal frame member 54 and inclined frame members 56 and 58 joined at the lower ends to a central plate 60 fixed to frame member 54 and joined at the upper ends to the corresponding sidewalls 50 and 52. Thus, the bridge roadway or deck 12 is supported by the combination of the piers and steel walls 50, 52 and frame assemblies in a known manner. In addition, the walls 50, 52 and frame assemblies provide the surfaces which must be periodically cleaned, such as by abrasive blasting or the like, and painted.

As shown in FIG. 2, the supporting cables 70 of the platform 30 of the present invention extend longitudinally of bridge 10 between the piers and are spaced apart substantially equally in a transverse direction relative to bridge 10. Thus, cables 70 are disposed in a plane substantially parallel to the plane of bridge deck 12. By way of example, in an illustrative bridge having a width of about 32 feet and a distance between piers of about 140 feet, seven steel cables 70*a*–70*g* each one-half inch in diameter are provided. The cables 70 are secured to a structure of bridge 10 so that the plane of the cables is at a desired distance below the portion of bridge 10 upon which work is to be performed. In the platform of the present illustration, cables 70*a*–70*g* are attached at opposite ends to piers 18 and 20 by compression clamp assemblies which will be described. The platform flooring, generally designated 74 in FIG. 2, rests on and is supported by cables 70*a*–70*g* . Flooring 74 comprises a plurality of sections or panels each releasably connected to corresponding cables 70 in a manner which will be described in detail presently.

Figure 3:
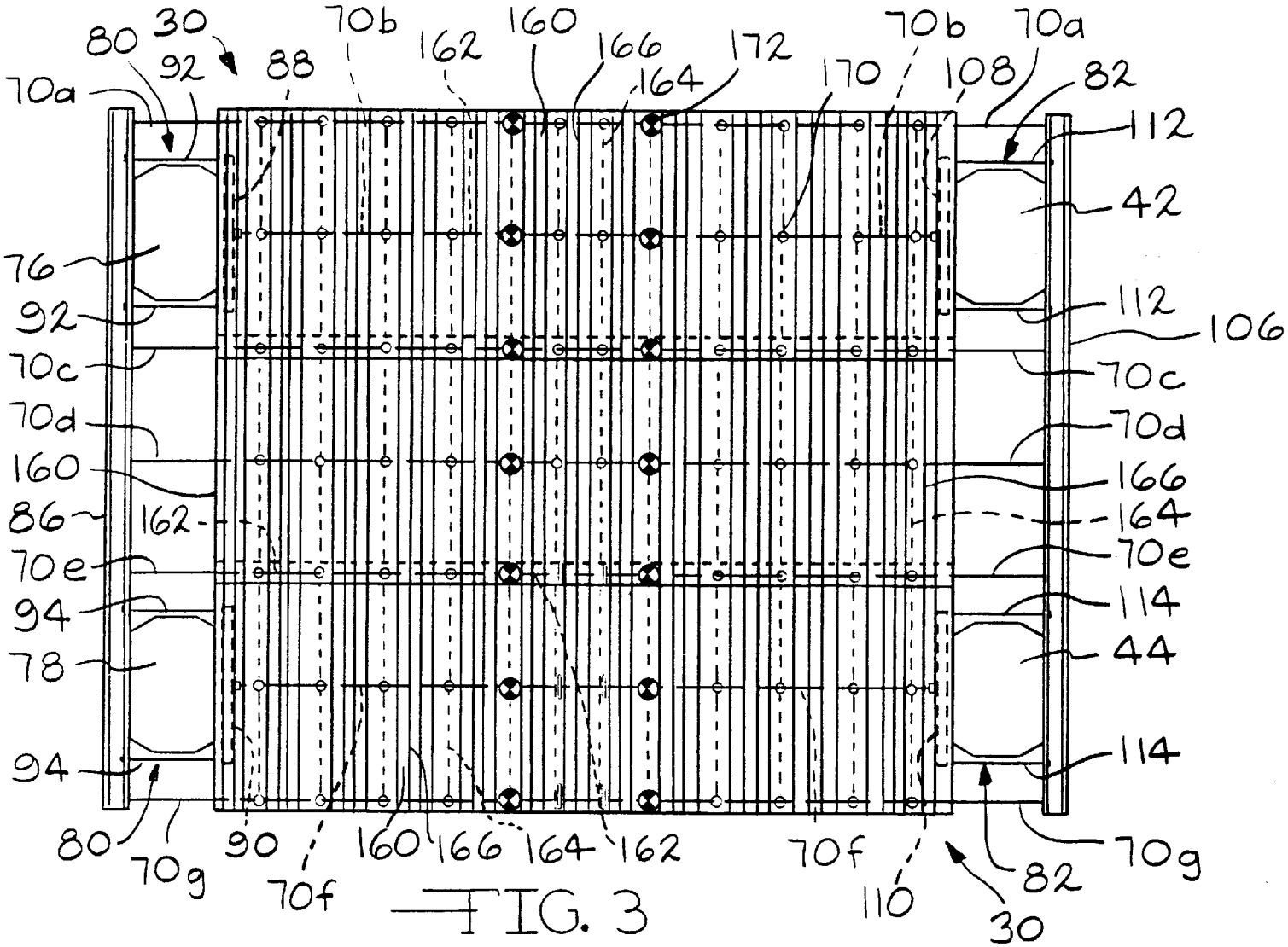
FIG. 3 is a plan view of the bridge platform of FIG. 1.

The plan view of FIG. 3 illustrates the clamping assemblies for attaching opposite ends of cables 70 to the bridge piers 18 and 20. The pedestals 42 and 44 of pier 20 are shown in FIG. 3. Pier 18 likewise has two pedestals designated 76 and 78 in FIG. 3. A first compression clamping assembly generally designated 80 secures all of the cables 70 at one end thereof, i.e. the left-hand end as viewed in FIG. 3, to pedestals 76 and 78 of pier 20. A second compression clamping assembly generally designated 82 and identical to assembly 80 secures all of the cables 70 at the opposite end thereof, i.e. the right-hand end as viewed in FIG. 3, to pedestals 42 and 44 of pier 20. Clamping assembly 80 comprises a first member or I-beam 86 extending transversely of bridge 10 and contacting both pedestals 76 and 78 on one side thereof and second and third members or I-beams 88 and 90 also extending transversely but each contacting only a corresponding one of the pedestals 76 and 78 and on the opposite side thereof. Members 86 and 88 are clamped to pedestal 76 by a plurality of threaded connecting rods 92 which are tightened to provide the required amount of compression force. Similarly, members 86 and 90 are clamped to pedestal 78 by a plurality of threaded connecting rods 94 which are tightened to provide the required amount of compression force. Thus, I-beam 86 contacts the left-hand surfaces of pedestals 76 and 78 as viewed in FIG. 3 and I-beams 88 and 90 contact the right-hand surfaces of pedestals 76 and 78, respectively, as viewed in FIG. 3. Cables 70*b* and 70*f* are connected at one end to I-beams 88 and 90, respectively, and the remaining cables 70*a*, 70*c*–70*e* and 70*g* are connected to I-beam 86. The clamping assembly and the manner of connecting cables 70 thereto will be described in further detail presently.

In a similar manner, clamping assembly 82 comprises a first member or I-beam 106 extending transversely of bridge 10 and contacting both pedestals 42 and 44 on one side thereof and second and third members or I-beams 108 and 110 also extending transversely but each contacting only a corresponding one of the pedestals 42 and 44 and on the opposite side thereof. Members 106 and 108 are clamped to pedestal 42 by a plurality of threaded connecting rods 112 which are tightened to provide the required amount of compression force. Similarly, members 106 and 110 are clamped to pedestal 44 by a plurality of threaded connecting rods 114 which are tightened to provide the required amount of compression force. Thus, I-beam 106 contacts the right-hand surfaces of pedestals 42 and 44 as viewed in FIG. 3, and I-beams 108 and 110 contact the left-hand surfaces of pedestals 42 and 44 as viewed in FIG. 3. Cables 70*b* and 70*f* are connected at the ends to I-beams 108 and 110, respectively, and the remaining cables 70*a*, 70*c*–70*e* and 70*g* are connected to I-beams 106.

Figure 4:
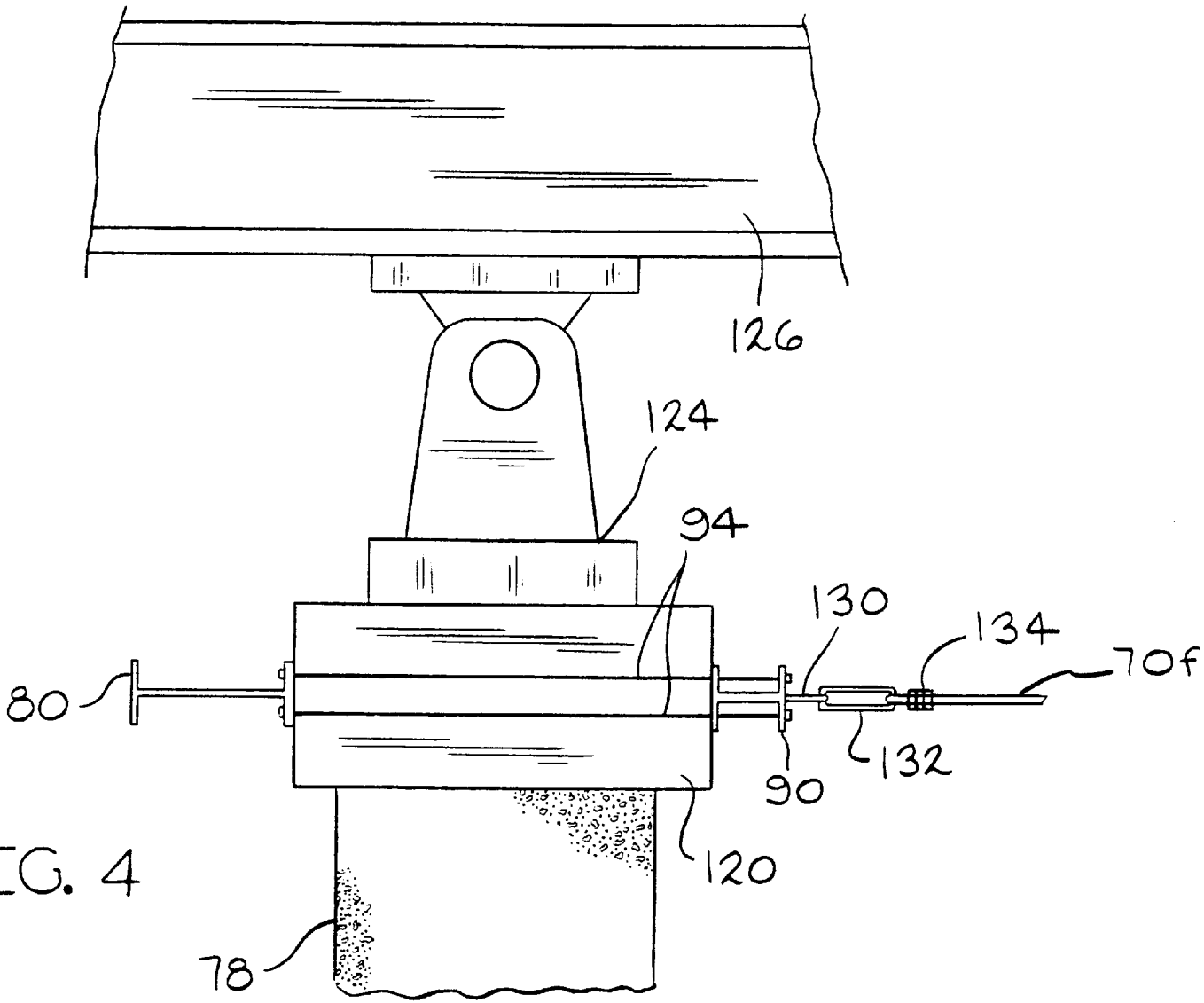
FIG. 4 is a fragmentary side elevational view of a clamp assembly in the bridge platform of FIGS. 1–3.

FIG. 4 illustrates in further detail a portion of one of the clamping assemblies, in particular the portion of clamping assembly 80 associated with pedestal 78 of pier 18. The arrangement illustrated in FIG. 4 is substantially similar to the portion of clamp assembly 80 associated with pedestal 76 of pier 18 and to the portions of clamps assembly 82 associated with pedestals 42 and 44 of pier 20. As shown in FIG. 4, pedestal 78 is provided with a cap 120 on which is mounted a beam bearing structure 124 on which a girder 126 of the sidewall 52 rests. I-beam 86 of clamp assembly 80 contacts the left-hand surface of pedestal cap 120 as viewed in FIG. 4 and I-beam 90 of the clamp assembly contacts the opposite or right-hand surface of cap 120. A pair of threaded connecting rods 94 join the flange of beams 86 and 90 on one side of pedestal cap 120 and a similar pair of connecting rods (not shown in FIG. 4) join the flanges of beams 86 and 90 on the opposite side of cap 120. The connection of cable 70*f* to beam 90 is provided by a plate-like extrusion 130 on the outer flange of beam 90 and a shackle 132 which fits in an opening in plate 130 and is connected by a cable clamps 134 to the end of cable 70*f*.

Figure 6:
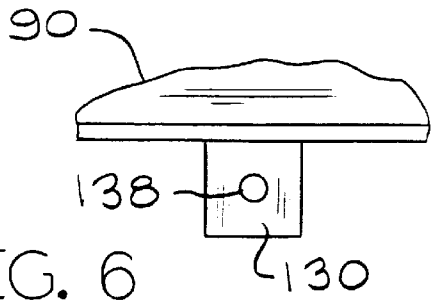
FIG. 6 is an enlarged fragmentary plan view of a portion of the assembly of FIG. 5.
Figure 7:
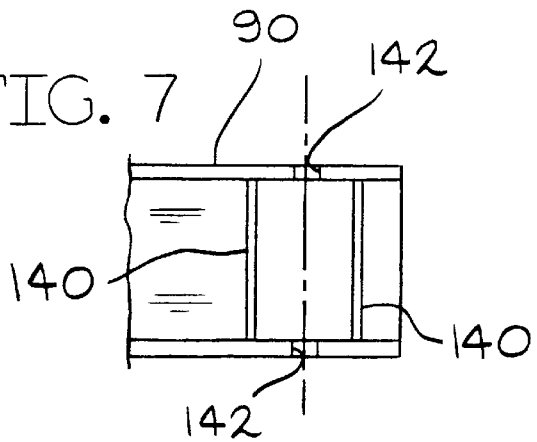
FIG. 7 is an enlarged fragmentary plan view of another portion of the assembly of FIG. 5.
Figure 5:
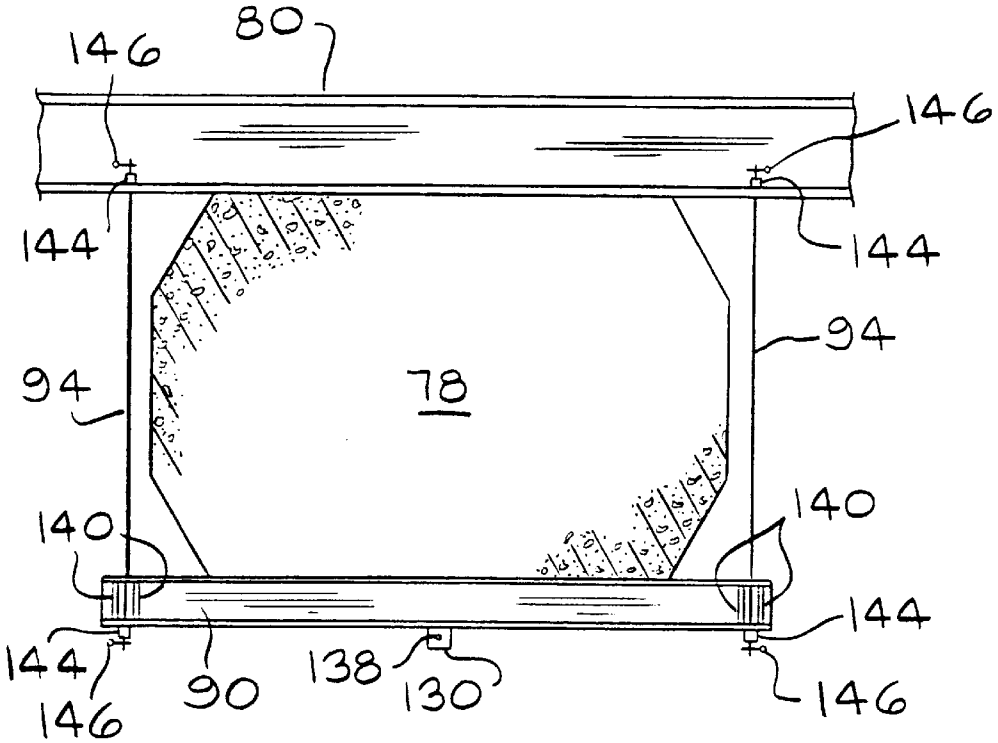
FIG. 5 is a fragmentary plan view of the clamp assembly of FIG. 4.

As shown in FIGS. 5 and 6, extension 130 which is welded to the flange of beam 90 is provided with an opening 138 to receive shackle 132. A shown in FIGS. 5 and 7, I-beam 90 is provided with reinforcing spacers 140 adjacent the openings 142 in the flanges through which rods 94 extend. Rods 94 are provided with washers (not shown), nuts 144 and cotter pins 146 on each end thereof as shown in FIG. 5. By way of example, in an illustrative bridge platform, I-beams 86 and 106 are W12×45 I-beams each 31 feet in length, I-beams 88, 90, 108 and 110 are W6×15 I-beams each 7 feet in length, connecting rods 92, 94, 112 and 114 are ⅝ inch diameter threaded rods each 4½ feet long, shackles 132 are ⅝ inch diameter, clamps 134 are MIH ⅝ inch cable clamps and cables 70 are ⅝ inch diameter wire rope cables each having 6×19 IPS fiber core.

In the bridge 10 of the present illustration, each pier has two bearing structures 124, one on each pier pedestal. Some bridges have a large number of bearing structures per pier, for example six, in which case the cables 70 could be secured to the bearing structures without the need for the clamping assemblies 80 and 82.

Referring again to FIG. 3, the platform flooring 74 comprises a plurality of elongated rectangular panels each designated 160 which are arranged in end-to-end overlapping relation transversely of bridge 10 and cables 70, as indicated by the broken lines 162 in FIG. 3, and which panels 160 are arranged in side-by-side overlapping relation longitudinally of bridge 10 and cables 70, as indicated by the broken lines 164 in FIG. 3. Panels 160 are corrugated decking panels with the corrugations extending transversely of cables 70 as indicated at 166 in FIG. 3. Having corrugations 166 extending transversely of cables 70 maximizes the rigidity and strength of flooring 74 and prevents any buckling of the panels 160. Each of the platform flooring sections or panels 160 is releasably connected at spaced locations to the supporting cables 70 on which it rests. This is provided by connector assemblies generally indicated at 170 in FIG. 3 and which will be described in detail presently. As a result, individual flooring sections or panels 160 can be removed to provide access through the flooring in emergency situations. For example, if a worker becomes seriously ill or injured, one or more flooring sections 160 can be quickly and easily removed thereby allowing the worker to be lowered safely to the ground below. In addition, collected debris remains in the corrugations of the removed panel and is not lost from containment within the area of the platform.

Some of the connector assemblies, i.e. those designated 172 in FIG. 3, also have the capability of an additional or auxiliary connection to the bridge structural steel 14 and will be described in detail presently.

Figure 8:
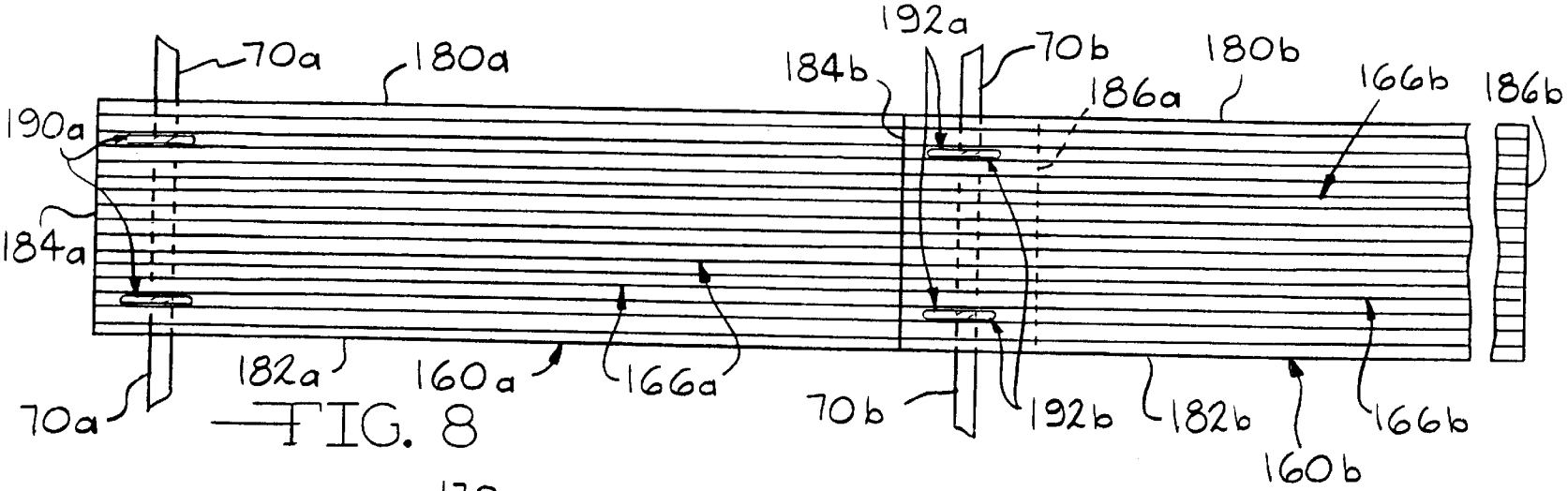
FIG. 8 is a plan view of one of the sections of flooring of the platform of the present invention as it appears resting on the supporting cables.
Figure 9:
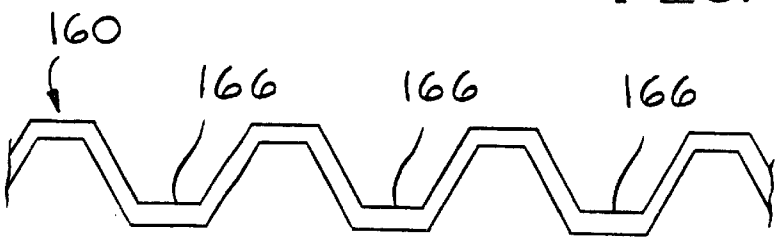
FIG. 9 is an end view of the platform section shown in FIG. 8.

FIG. 8 shows in further detail two laterally adjacent panels designated 160*a* and 160*b* and their association with two of the supporting cables, for example cables 70*a* and 70*b*. Panel 160*a* has a pair of side edges 180*a*, 182*a* which are joined by a pair of end edges 184*a*, 186*a*. Corrugations 166*a* extend longitudinally along panel 160*a* and substantially parallel to side edges 180*a*, 182*a*. As shown in FIG. 8 the corrugations 166 of all the panels 160 in flooring 74 extend transversely of cables 70 so as to provide the required strength and rigidity of the platform 30. The corrugations 166*a* of panel 160*a* are shown in further detail in the end view of FIG. 9.

Similarly, panel 160*b* has a pair of side edges 180*b*, 182*b* which are joined by a pair of end edges 184*b*, 186*b*. Corrugations 166*b* extend longitudinally along panel 160*b* and substantially parallel to side edges 180*b*, 182*b*. The panels 160*a* and 160*b* are in overlapping end-to-end relation as shown by the locations of the respective end edges 186*a* and 184*b* in FIG. 3.

Each of the panels 160 comprising flooring 74 includes a plurality of openings extending therethrough for making connection to cables 70. The number and location of openings will depend upon the size of panels 160 and the distance between cables. In the panels illustrated in FIG. 8, panel 160*a* includes a first pair of openings 190*a* located near end 184*a* and a second pair of openings 192*a* located near end 186*a*. Similarly, panel 160*b* includes a first pair of openings 192*b* located near end 184*b* and a second pair of openings (not shown) located near end 186*b*. Openings 192*a* in panel 160*a* are in alignment with openings 194*b* in panel 160*b*. Each of the openings, for example opening 190*a*, is elongated and disposed with the longitudinal axis thereof substantially parallel to corrugation 166 and thus transversely of cables 70.

Figure 10:
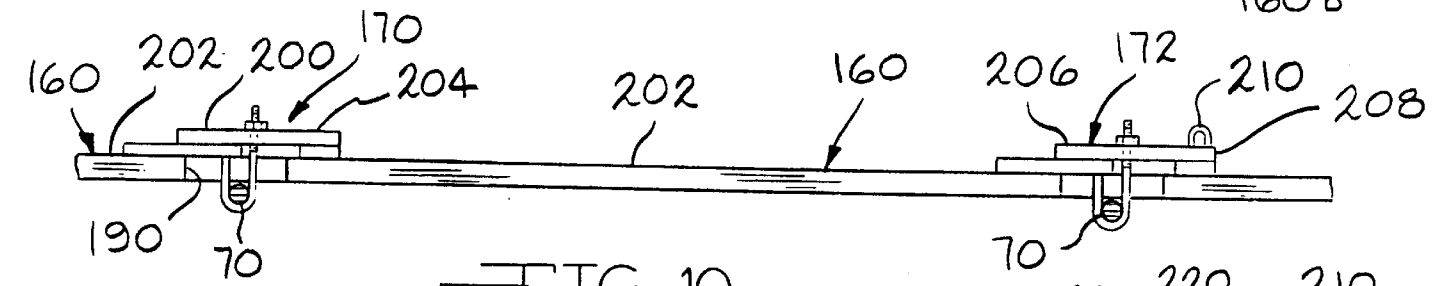
FIG. 10 is a side elevational view of the flooring section of FIG. 8 with connector assemblies installed thereon for securing the flooring to the cable.

As shown in FIG. 10, the openings in the panels 160 enable the connector assemblies 170, 172 to contact or engage both the cables 70 and panels 160 in a manner releasably connecting the panels to the cables. In particular, connector assembly 170 includes a first part 200 which engages the upper surface 202 of panel 160 and which also engages the cable 70 and a second part 204 which engages the upper surface 202 of panel 160, the two parts being removably connected together through opening 190 in a manner which will be shown and described in detail presently. Similarly, connector assembly 172 includes a first part 206 which engages the upper surface 202 of panel 160 and which also engages the cable 70 and a second part 208 which engages the upper surface 202 of panel 160, the two parts being removably connected together through opening 192 in a manner which will be described in detail presently. The first part 206 of connector assembly 172 is identical to the first part 200 of connector assembly 170. The second part 208 of connector assembly 172 is provided with an eyelet 210 for connection to one end of an auxiliary cable, not shown in FIG. 10, the other end of which is connected to the bridge structural steel 14 such as are of the frame assemblies shown in FIG. 2. For convenience in illustration, both connector assemblies 170 and 172 are shown in FIG. 10 joining a single panel 160 to cables 70. However, the connector assemblies 170 and 172 will also join overlapping end portions of adjacent panels 160 to cables 70 as shown in FIG. 3.

Figure 11:
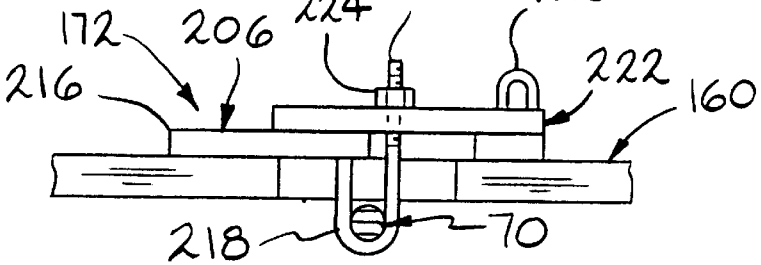
FIG. 11 is an enlarged fragmentary side elevational view of one of the connector assemblies of FIG. 10.

The connector assembly 172 is shown in further detail in the enlarged view of FIG. 11. The first part 206 comprises a plate-like body 216 an a substantially U-shaped hook formation 218 which extends therefrom for engaging cable 70 and which is provided with a threaded end portion 220 which projects through an opening (not shown in FIG. 11) in the plate-like body 222 of the second part 208 of assembly 172. A nut 224 fastens the two parts together.

FIGS. 12 and 13 show in further detail the first part 206 of connector assembly 172. As previously mentioned, the first part 206 of connector assembly 172 is identical to the first part 200 of connector assembly 170. The plate-like body 216 of part 206 is elongated rectangular in shape having oppositely directed surfaces 230 and 232 bounded by a pair of side edges 234 and 236 joined by a pair of end edges 238 and 240. The U-shaped hook formation 218 has one end 242 welded or otherwise joined as indicated at 244 to surface 232 of body 216 at a location slightly inwardly of end 240 and midway between sides 234 and 236. The other end 246 of formation 218 extends beyond surface 230 as shown in FIG. 12. The threaded end portion 220 extends inwardly from end 246. For convenience in illustration, only part 206 of connector assembly 172 is shown in FIGS. 12 and 13, it being understood that part 200 of connector assembly 170 is identical.

FIGS. 14 and 15 show in further detail the second part 208 of connector assembly 172. The plate-like body 222 of part 208 is elongated rectangular in shape having oppositely-directed surfaces 250 and 252 bounded by a pair of side edges 254 and 256 and joined by a pair of end edges 258 and 260. An opening 262 is provided through body 222 at a location between sides 254 and 256 and offset toward end 258 a short distance from the mid-point between ends 258 and 260. Opening 262 is of a diameter to receive threaded end 220 in a close, sliding relation. Nut 224 shown in FIG. 14 is threaded on end 220 of hook formation 218 to fasten the two connector parts 206 and 208 together. Body 222 is provided with a foot-plate 263 welded or otherwise fixed to the lower surface 252 to stabilize its placement on plate 216 of connector part 206 and on upper surface 202 of panel 160. The structure of part 208 shown and described up to this point is identical to part 204 of connector assembly 170.

Part 208 of connector assembly 172 is provided with a U-shaped eyelet member 210 which is welded or otherwise joined as indicated at 264 to surface 250 of body 222 at a location between opening 262 and edge 260. Eyelet 210 receives one end of an additional or auxiliary supporting cable (not shown in FIGS. 14 and 15), the other end of which is secured to the bridge structural steel 14 including the frames shown in FIG. 2. Examples of such auxiliary cables are the cables 32 shown in FIGS. 1 and 2.

The platform sections or panels 160 and the connector assemblies 170, 172 are installed to provide a completed platform 30 in the following manner. The panels 160 are placed and arranged on the cables 70 by workmen using scaffolds or the like supported by the bridge 10. Panels 160 are placed on the supporting cables 70 so that the corrugations 166 are disposed transversely of the cables 70. Panels 160 are arranged in a row and in end-to-end overlapping relation transversely of the cables 70. The panels 160 are located so that the openings 190, 192 are aligned with various ones of the cables 70 as shown in FIG. 8. Furthermore, with adjacent ones of the panels 160 being in end-to-end overlapping relation, the openings 190, 192 of the overlapping portions of adjacent panels 160 in a row are aligned with each other and with the corresponding cables 70.

Next, the connector assemblies 170, 172 are installed manually by the workmen. In particular, the first part 200 of connector assembly 170 is manipulated with the flat base inclined upwardly from the upper surface 202 of panel 160 so that the U-shaped hook formation of part 200 can be inserted through the opening in panel 160 and around the cable 70. Then the flat base is pivoted or otherwise manipulated so that cable 70 is within the U-shaped hook formation and the threaded end of the U-shaped hook extends upwardly from surface 202 as shown in FIG. 10. Then, the second part 204 is placed on surface 202 of panel 202 and on the base plate of the first part 202 so that the threaded end of the hook formation extends up through the opening in the base of the second part. Then nut 224 is threaded on the end of the hook formation and tightened onto the base of the second part 204 to hold the two parts of the connector assembly 170 together and in secure engagement with panel 160 and cable 70.

The foregoing operation is repeated for each of the connector assemblies in each of the panels along the row. Then the panels 160 of the next row are installed, the row extending transversely of the cables 70 and the panels of the next row being adjacent sideways to the panels of the first row. The panels of this next row are in end-to-end overlapping relation in the same manner as the panels of the first row. In addition, the panels of this next row are in side-to-side overlapping relation with the panels of the first row as shown in FIG. 3. The connector assemblies are installed in the panels of this next row in a manner similar to that of the first row. The foregoing installation of rows of panels 160 and installation of connector assemblies is continued in a direction longitudinally of the cables 70 until the platform 30 is completed. Connector assemblies 172 of the second type are installed at spaced locations, for example about 20 feet, over the surface of platform 30, and auxiliary cables such as cables 32 are connected between the assemblies 172 and bridge structural steel 32.

Figure 16:
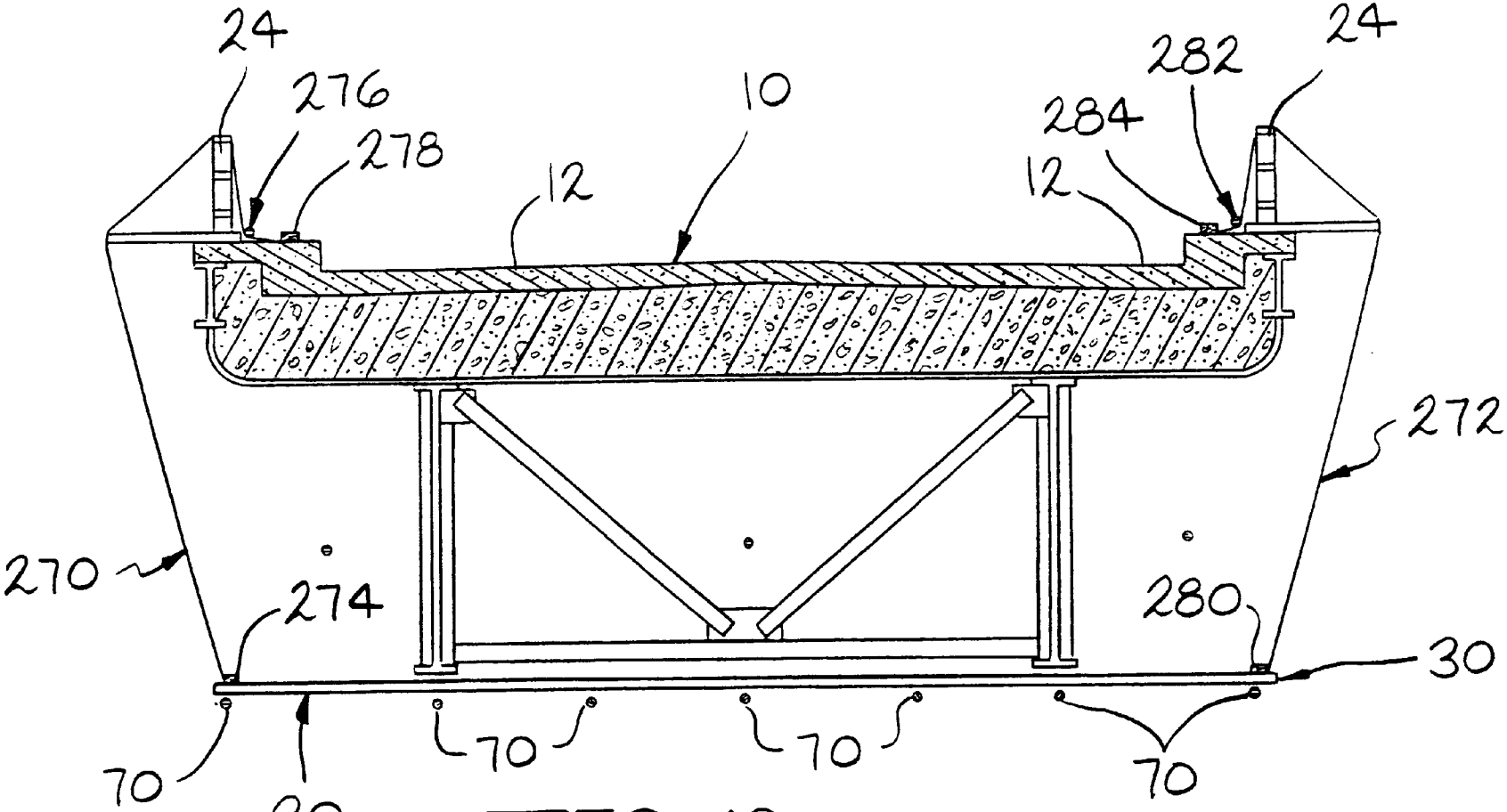
FIG. 16 illustrates the platform of the present invention in combination with tarpaulin enclosures.

As previously described, the platform flooring 74 and particularly the corrugations 166 of panels 160 are very effective in containing debris such as paint chips removed from the bridge steel 14 and frames thereof as well as paint droppings or spillage during the actual painting operation. In some situations, particularly under windy conditions, it is necessary to take extra measures to confine the debris and paint and prevent its movement or escape due to wind or other effects. Accordingly, an enclosure is defined between platform 30 and the bridge by means of tarpaulins as shown in FIG. 16. In particular, tarpaulin enclosures 270 and 272 are provided extending along the left-hand and right-hand sides of platform 30. The lower end of tarpaulin enclosure 270 is fastened to the side edge of platform 30 by lumber stripping 274 or the like screwed to the panels 160 of platform 30 to provide a continuous seal. The upper end of tarpaulin enclosure 270 extends over the bridge railing 24 and is fastened to the bridge deck 12 or sidewalk thereof by the combination of cable 276 extending along the deck and lumber stripping 278 or the like secured to the deck. Similarly, tarpaulin enclosure 272 is fastened at the lower end to platform 30 by stripping 280 and at the upper end to deck 12 by cable 282 and stripping 284. If desired, similar tarpaulin enclosures can be provided at opposite ends of platform 30. Thus, platform 30, the tarpaulin enclosures and the bridge deck 12 define a confined region or volume for containing debris from the operations being performed.

By way of example, in an illustrative platform, the overall width is about 32 feet or slightly less than the width of the bridge deck 12 and the overall length of the platform is about 140 feet which is approximately the span between piers 18, 20. Panels 160 are rigid type B corrugated steel decking panels each 11 feet in length and 3 feet in width. The panels 160 are 0.22 gage, 1½ inch deep ASTM A446 steel having a yield strength of FY=33KSI (minimum). A minimum panel overlap of 6 inches in longitudinal and lateral directions is provided. Cables 70 are seven in number, each ½ inch in diameter and spaced apart about 5 feet. Cables 70 are 6×19 IWRC cable of plain steel with a breaking strength of 41,200 pounds or greater. Each panel 160 is connected at two locations to the corresponding cable. The location of platform 30 is about 11½ feet below bridge deck 12. The typical maximum applied load for which platform 30 is designed is 11 pounds per square foot. The cables 70 are supported every 20 feet by the auxiliary support cables such as those designated 32.

Platform 30 of the present invention by virtue of the combination of support cables 70 and corrugated decking panels 160 is safe, provides a sufficiently rigid support for workmen to stand and walk on and is relatively simple in structure and light in weight. Rigidity is important in that workmen can walk along platform 30 with no lowering. The corrugations 166 enhance the strength to weight ratio of panels 160. In addition, the corrugations facilitate containment of debris. The provision of connector assemblies 170 and 172 in cooperation with openings 190 and 192 in the panels provide a quick, easy and effective way to both erect and dismantle the bridge platform of the present invention. The provision of individual panels 160 releasably connected to cables 70 provides convenient and quick access through the flooring 74 in emergency situations. Thus in such situations it is not necessary to cut through the platform flooring which otherwise could destroy the integrity of debris containment provided by enclosures such as that shown in FIG. 16. Furthermore, the time required to cut through flooring could have serious consequences in emergency and critical situations, and such cutting could impair the structural integrity of the platform and therefore its safety.

It is therefore apparent that the present invention accomplishes its intended objects. While an embodiment of the present invention has been described in detail that is for the purpose of illustration and not limitation.

What is claimed is:

1. In combination with a bridge having a deck, a platform disposed below said bridge deck and attached to said bridge and extending along a portion of the bridge for supporting persons performing work on the bridge portion and for collecting debris resulting from the work, the platform comprising:

a) a plurality of cables extending along said bridge and in spaced relation to each other and in a plane substantially parallel to the plane of said bridge deck;

b) means at each end of said cables for securing said cables to said bridge so that the plane of the cables is at a desired distance below the bridge portion;

c) a floor comprising a plurality of flooring panels each extending transversely of said cables and resting on said cables, each of said panels having at least one means defining an opening therein; and d) means for releasably securing said flooring panels to said cables, said releasably securing means including means defining eyelets on said flooring panels, each said opening at least partially receiving one of said eyelets, and said cables passing through respective ones of said eyelets on said flooring panels.

2. A combination according to claim 1 wherein said bridge further has at least two spaced apart structural members and wherein said cable securing means comprises a compression clamp structure on each of said structural members, said cables being connected at each of opposite ends thereof to one of said compression clamp structures.

3. A combination according to claim 1 wherein said eyelet means comprises, for each of said flooring panels, a first part which engages said respective flooring panel and a second part which extends through said opening means in said respective flooring panel for engaging one of said cables, said releasably securing means being disconnectable so that each individual flooring panel can be removed to allow-access through the flooring.

4. A combination according to claim 1 wherein said flooring panels comprise corrugated elongated rectangular decking members with corrugations thereof extending transversely of said cables.

5. A combination according to claim 1 wherein the bridge also has at least two spaced apart structural supports, said plurality of cables extend between said structural supports, and said cable securing means includes at least one member clampingly connected to each of said structural supports, said cables secured at respective ends thereof to said clampingly connected members respectively.

6. A combination according to claim 1 wherein the bridge also has at least two spaced apart structural supports, said plurality of cables extend between said structural supports, and said cable securing means includes first beam means for contacting a surface of a respective one of said structural supports, second beam means for contacting an opposite surface of said respective one structural support, and compression force applying means for forcing said first and second beam means against said respective one structural support.

7. A combination according to claim 1 wherein the bridge also has at least two spaced apart piers each having a pair of pedestals, said plurality of cables extend between said piers, and said cable securing means includes a single beam for contacting both of said pedestals of said respective pier, a pair of beams for contacting said pedestals respectively of said respective pier, and connecting rods for compressing said pair of beams and said single beam against said pedestals.

8. A combination according to claim 1 further comprising at least one auxiliary supporting cable one end of which is connected to a respective one of said releasably securing means and an other end of which is connected to the bridge to provide additional support for said platform.

9. A combination according to claim 1 further comprising at least one tarpaulin enclosure extending between said platform and the bridge for defining a region between said platform and the bridge which enhances containment of the debris.

10. A combination according to claim 3 wherein said second part comprises a plate-like body for engaging an upper surface of said respective panel and a substantially U-shaped hook formation extending from said body and through said opening means for engaging said respective cable and having a threaded free end portion which terminates above said respective panel, and wherein said first part comprises a plate-like body having an opening therethrough for receiving therethrough said threaded free end portion of said hook formation of said second part so that a nut can be threaded on said free end portion to fasten said first and second parts together.

11. A method for supporting persons performing work on a portion of a bridge comprising installing a platform below a deck of the bridge and supporting the persons on the platform, the step of installing the platform comprising the sub-steps of:

a) securing a plurality of cables to the bridge so that the cables extend along the bridge in spaced relation to each other and in a plane substantially parallel to the bridge deck at a selected distance below the bridge portion;

b) erecting a floor on the cables, the step of erecting the floor comprising resting on the cables a plurality of flooring panels each having at least one opening therein so that the flooring panels extend transversely of the cables; and d) releasably securing the flooring panels to the cables, said sub-step of releasably securing the flooring panels including at least partially receiving in each of the openings and attaching to the respective flooring panel structure forming an openable eyelet, receiving the cables in the eyelets respectively while the eyelets are open, and closing the eyelets.

12. A method according to claim 11 wherein the sub-step of securing the cables comprises installing a compression clamp structure on each of a pair of spaced apart bridge structural members and connecting opposite ends of the cables to the compression clamp structures respectively.

13. A method according to claim 11 wherein the sub-step of releasably securing the flooring panels comprises, for each of the flooring panels, engaging one part of the eyelet structure with the respective flooring panel, extending an other part of the eyelet structure through the opening in the respective flooring panel and engaging one of the cables therewith, and engaging the parts so that the structure is disconnectable so that each individual flooring panel can be removed to allow access through the flooring.

* * * * *